US006346055B1

(12) United States Patent
Rège

(10) Patent No.: US 6,346,055 B1
(45) Date of Patent: Feb. 12, 2002

(54) GOLF PLAY PACING METHOD

(76) Inventor: Kathleen Rège, 2429 Walnut Grove Ave., San Jose, CA (US) 95128

( * ) Notice: Subject to any disclaimer, the term of this patent is extended or adjusted under 35 U.S.C. 154(b) by 0 days.

(21) Appl. No.: 09/570,360

(22) Filed: May 12, 2000

Related U.S. Application Data

(63) Continuation-in-part of application No. 09/074,450, filed on May 6, 1998, now Pat. No. 6,062,985.

(51) Int. Cl.[7] ..... A63B 57/00

(52) U.S. Cl. ..... 473/409; 473/199; 368/10; 368/107

(58) Field of Search ..... 473/409, 198, 473/199; 368/10, 107–113

(56) References Cited

U.S. PATENT DOCUMENTS 5,216,641 A * 6/1993 Hoel ..... 368/10
5,335,212 A * 8/1994 Bartos ..... 368/107
5,357,487 A * 10/1994 Coleman, III ..... 368/10
5,386,990 A * 2/1995 Smith ..... 473/199
5,523,985 A * 6/1996 Nixon ..... 368/107
5,642,334 A * 6/1997 Liberman ..... 368/10
5,646,911 A * 7/1997 Davis ..... 368/10
6,062,985 A * 5/2000 Rege ..... 473/199

* cited by examiner

*Primary Examiner*—Mark S. Graham
*Assistant Examiner*—Raeann Gorden
(74) *Attorney, Agent, or Firm*—The Kline Law Firm

(57) ABSTRACT

A golf play pacing system utilizing a device that is contained in the flag stick itself. The system is initiated either by an external device or by an activation switch in the flag stick that is activated when the stick moves through an arc of approximately 45°, and reactivated when the stick is returned to perpendicular. The system includes circuitry that measures a plurality of parameters since the last reset of the device, and activates alarm mechanisms when specific time parameters have expired. The alarm mechanism includes visual and audible alarms for the golfers and alarm communication capability to alert third parties. The system also includes a data display.

16 Claims, 7 Drawing Sheets

Circuitry Block Diagram

Operational Parameters

| Standard Parameters | Setting | Options |
|---|---|---|
| Initial power up | Default = Sleep | User may select initial power up puts device into an interval timing mode<br>• Putt<br>• Approach |
| Activation Degree | Default =<br>>45° activates<br><45° resets | User may define different degree of activation movement required |
| External Initial Activation | Default = Off | User may define initial activation from a source other than movement |
| Play Interval | Default = Total Play | User may select<br>• Approach and Putt |
| Initial Timing Interval | Default = Play | User may select<br>• Approach<br>• Putt interval |
| Pace Time Read-out | Default = 30 seconds | User may select different display time, in 10 second intervals |
| Total Play Interval | Default = 7 min | User may select 1 minute increments from 4 to 15 minutes |
| Chipping Extension | Default = 2 min | Interval may be defined by course |
| Number of Extensions | Default = 1 each | Number permissible extensions<br>• Approach<br>• Putt |
| Past Extension | Default = sleep | Unit may alert instead of sleep |
| **Optional Parameters** | **Setting** | **If selected, options available** |
| Visual Alert | On/Off | Distance selection in feet or centimeters |
| Audible Message | On/Off | • Selection of pre-recorded messages<br>• User recorded messages<br>• Condition for message selected |
| Putt Interval | On/Off | Putt interval duration<br>• user defines intervals |
| Extended Alert | On/Off | Extended alert Selection<br>• Approach<br>• Putt<br>• Open Hole<br>Extended alert interval duration<br>• user defines intervals |

Fig. 5a

| Optional Parameters | Setting | If selected, options available |
|---|---|---|
| Management Communication | On/Off<br>If On, then select type | If "On" then identify type:<br>• FM (define type)<br>• Infrared<br>• Radar<br>• User defined: |
| Cautionary Alerts | On/Off | Alert Selection<br>• Approach<br>• Putt<br>Cautionary Alert interval duration<br>• User defines interval |

Fig. 5b

GOLF PLAY PACING METHOD

This application is a continuation-in-part of Applicant's co-pending application Ser. No. 09/074,450, filed May 6, 1998, now U.S. Pat. No. 6,062,985.

FIELD OF THE INVENTION

The present invention relates generally to a timing and alarm method for monitoring pacing on a golf course, and more particularly is a method that utilizes a device that is either built into the flag sticks or is added onto existing flag sticks.

BACKGROUND OF THE INVENTION

Golf is one of the oldest and most popular games in the world. The game is played in a great many countries, and is enjoyed by a tremendously broad spectrum of participants. However, it is the broad-spectrum appeal of the game that can lead to some problems in play.

Due to the nature of the game of golf, a large amount of land area is required for each golf course. This fundamental requirement of a large amount of space means that in populous areas, where demand is greatest, there are relatively few courses. Because of the game's great popularity, the capacity of these courses is sometimes pushed to the limit or exceeded. When a course is near capacity, maintaining the pace of play becomes critical. Even on a course that is not at all crowded, a golfer or group of golfers playing behind a slow group can have their enjoyment of a round diminished greatly due to the delay caused by the preceding group. The delay is due not only to the wide range of skill levels present on a course, but slow play is also sometimes simply a matter of players not having an effective means of being made aware of the pacing of their play.

It is acknowledged in the industry that growth in the number of players must be stimulated in order to maintain golf's financial performance. The National Golf Foundation' 1999 Strategic Perspective on the Future of Golf recommends that local courses focus on motivating new players to take up the sport, encouraging beginners to stay with the game, and allowing avid golfers to play more often. According to USA Today and NGF Golf On-Line, 96% of golfers feel that the speed of play is an issue on golf courses.

Accordingly, there have been many efforts made in terms of prior art devices that track and/or notify golfers of the pace of their play One such device is the "Variable Time Segment Pace Timing Device" of Coleman, U.S. Pat. No. 5,357,487, issued Oct. 18, 1994. The device includes a plurality of timing elements that can be programmed for the amount of time that the player desires to be allotted for each hole of the course. The timing can be varied to allow for changing conditions including number of players in a group and daylight hours available. The device is to carried by at least one of the golfers.

Another tracking method is the "System for Monitoring Play of a Golfer" of Mathews, U.S. Pat. Nos. 5,086,390 and 5,097,416, issued Feb. 4, 1992, and Mar. 17, 1992 respectively. This system utilizes transmitters positioned at the tees of each of the holes of the course to activate receivers carried by the golfers. The system also includes a means of notifying the course management of slow players.

Another device to time play is the "Golf Course Timer to Alleviate Slow Play" of Nixon, U.S. Pat. No. 5,523,985, issued Jun. 4, 1996. This device is worn like a wristwatch by the golfer, and includes means to set the desired time to complete the round. The hour indicators of a normal wristwatch are replaced with the numbers of the holes of the golf course.

Still another timing device is the "Golf Course Timing Method and System" of Smith, U.S. Pat. No. 5,386,990, issued Feb. 7, 1995. This device includes provisions for specifying the time to be allotted for each hole, for tracking the time of play, and for communicating the information to course personnel.

The "Golf Clock" of Bartos, U.S. Pat. No. 5,335,212, issued Aug. 2, 1994, is another example of a programmable clock device. This device includes a digital display and is intended to be mounted on the user's golf cart.

An earlier version of a timing system is disclosed in "System and Method of Timing Golfers on a Golf Course" by Wolfe, U.S. Pat. No. 4,303,243, issued Dec. 1, 1981. This system allows the users to determine whether or not they are playing according to a prescribed time limit for each hole, as well as comparing their playing pace to other groups on the course. Unfortunately, the device does not display the timing for a current hole, but rather the display is made on the succeeding tee box.

The prior art devices and methods for pacing are subject to one or more of the following shortcomings: First, the current art assumes a willingness of the players themselves to activate and monitor the devices.

Another drawback to prior art devices and methods is that they are dependent on the golfers' start time as opposed to actual playing conditions on the course.

Another drawback to prior art devices and methods is that they can be easily ignored. The mobile monitoring units can be placed in a golf bag or cart out of sight and thus can be completely ignored. Display boards or clocks posted at tee boxes may also be unnoticed by the golfers.

Accordingly, it is an object of the present invention to provide a golf play pacing method that utilizes a device that is mounted directly in the flag sticks of the golf course.

It is a further object of the present invention to provide a pacing means that is dependent on the real-time playing interval for each hole relative to the pace on the course, not simply a function of the start time of a round.

It is a still further object of the present invention to provide a method that utilizes a device that remains in a passive state until a pacing parameter has been exceeded. This characteristic of the device ensures that golfers who are not causing a pacing problem are not required to be involved in any way with the pacing device.

It is yet another object of the present invention to provide a signal display that is very conspicuous so that it is difficult for the players to ignore the pacing warnings. The signal display of the present invention is always in the line of sight of the golfers.

SUMMARY OF THE INVENTION

The present invention is a method of tracking the pace of golf play utilizing a flagstick based pace tracking device. The pacing device is activated either by an external device or by an orientation sensing mechanism in the flag stick that is activated when the stick is moved through an arc of approximately 45°. The mechanism is reset when the stick is returned to perpendicular. The pacing device includes circuitry that measures the time expired since the last reset of the device, and activates user-selected communication mechanisms when that time is expired. The communication mechanisms include visual displays and audible signals to the golfers, as well as signals to third parties. Monitored parameters can be defined/selected for total or partial hole playing time measurement.

An advantage of the present invention is that its operation is automatically controlled by actions inherent to playing golf, (removal of the flag stick from the cup), and thus does not require affirmative actions by the golfers.

Another advantage of the present invention is that it provides instant performance information to the golfer when the flagstick is placed back in the cup. The golfer's target-to-actual play time is immediately displayed.

Another advantage of the present invention is that it controls the pace of play for each hole, and is therefore not affected by the start time of individual golfers, nor by the combined play and move times.

A still further advantage of the present invention is that the timing mechanism can be adjusted to accommodate variable factors affecting the course.

A still further advantage of the present invention is that it can be initiated by an external mechanism.

These and other objects and advantages of the present invention will become apparent to those skilled in the art in view of the description of the best presently known mode of carrying out the invention as described herein and as illustrated in the drawings.

BRIEF DESCRIPTION OF THE DRAWINGS

FIGS. 5A and 5B list operational parameters that are set by a user of the device.

DETAILED DESCRIPTION OF THE INVENTION

Figure 1:
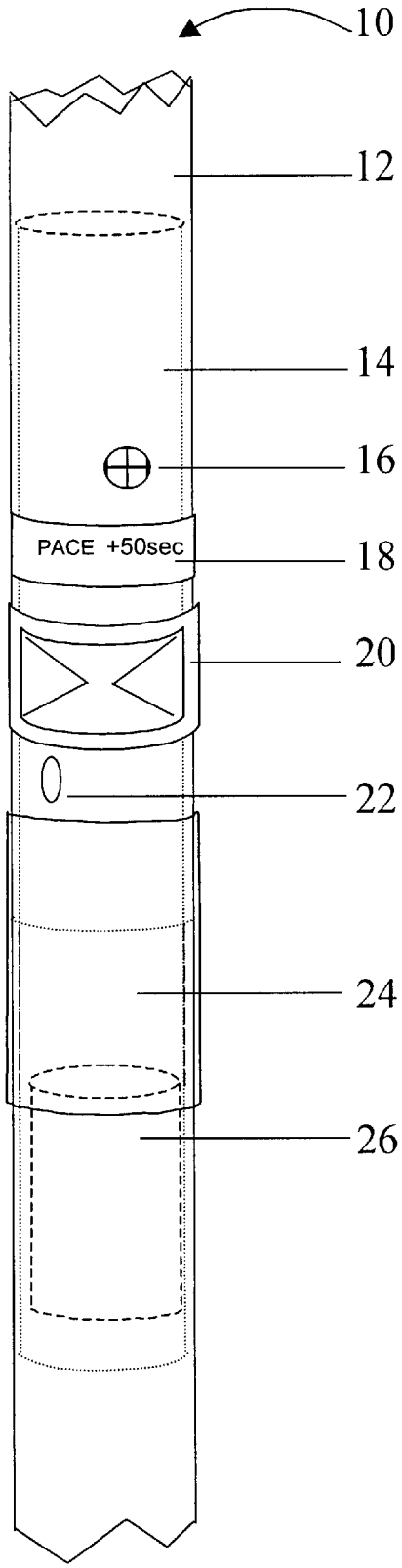
FIG. 1 is a perspective view of the pacing device of the present invention built into a flag stick.

The present invention is method of pacing play on a golf course that utilizes a pacing device 10 that is mounted in or on a flag stick or pin 12. A first preferred embodiment of the device is illustrated in FIG. 1. In this embodiment, the device is built-in to the flag stick 12. The controlling circuitry 14 for the built-in unit 10 is contained within a hollowed housing compartment on the flag stick 12. An access mechanism 24 allows a user to access the options settings for the device 10. Among the option settings are at least a display of an elapsed time readout, interval detail, total play time summary, audible alerts, external activation, and distance visibility.

A data display means 18 enables the golfers to see exactly what their pace is relative to the target pace for the course. The data display means 18 is used to display the time differential of the user's current play compared to the target time for each hole. Thus the golfers can determine not only whether they are within the prescribed time limits, but also by exactly how much they vary from the target time.

In order to alert golfers when they have exceeded a designated time for play on a given hole, an alarm light module 20 is included in the device. The light module 20 includes flashing or strobe lights that serve as a highly noticeable signal of exceeding time for play. In addition, a speaker 16 provides an audible warning for any group exceeding target time limits.

If the golfers do exceed the preset time limit before finishing play on a given hole, a manual time extension switch 22 can be used to deactivate the alarm light module 20 and the speaker 16 to allow the golfers to chip onto the green or to finish putting without distraction. When the manual time extension switch 22 is activated, the alert mechanisms of the device are put into a sleep mode while the play interval timer continues to measure total play intervals.

Figure 2:
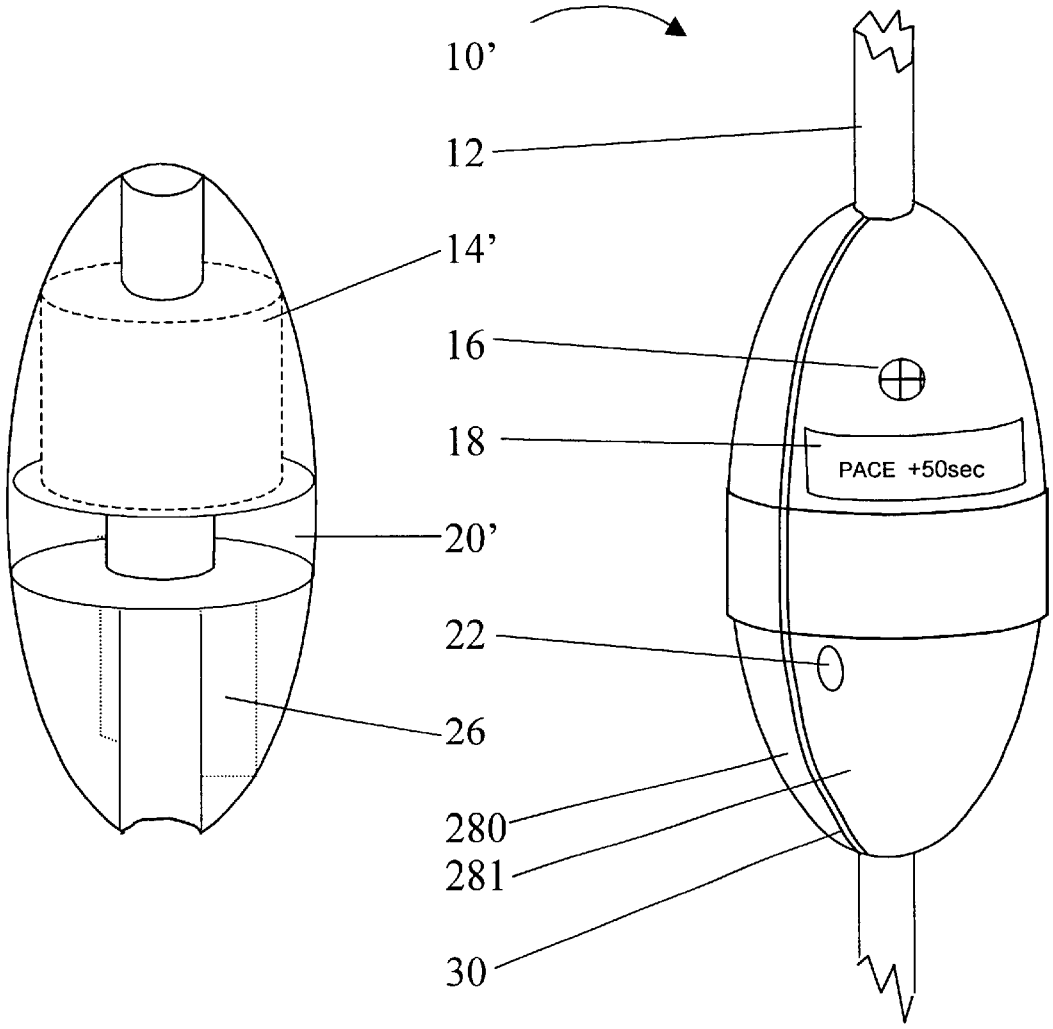
FIG. 2 is a perspective view of the pacing device of the present invention as an add-on unit.

An alternate embodiment of the device used in the pacing method of the present invention is shown in FIG. 2. This embodiment presumes that the device will be an add-on unit 10' that is adapted to fit over an existing flag stick. The add-on unit 10' utilizes controlling circuitry 14', a manual time extension switch 22, and a power source cluster 26 that comprises a CPU power source 260, a customer experience circuit (CEC) power source 261, and a transceiver power source 262. The components of the add-on unit 10' are the functional equivalents of those of the built-in unit 10.

The add-on unit 10' includes a cylindrical housing, comprised of a first section 280 and a second section 281, that contains the functional elements of the unit 10'. The functional elements include the operating circuitry 14' and the alarm light 20'. The components of the add-on unit are configured slightly differently as compared to those of the built-in unit so as to accommodate the different housing that is used. The housing sections 280, 281 include a central throughway so that the unit 10' fits over or around the existing flag stick 12. After the housing is placed onto the flag stick 12, it is secured by an attachment means 30 so that its position on the stick cannot change significantly.

Figure 3:
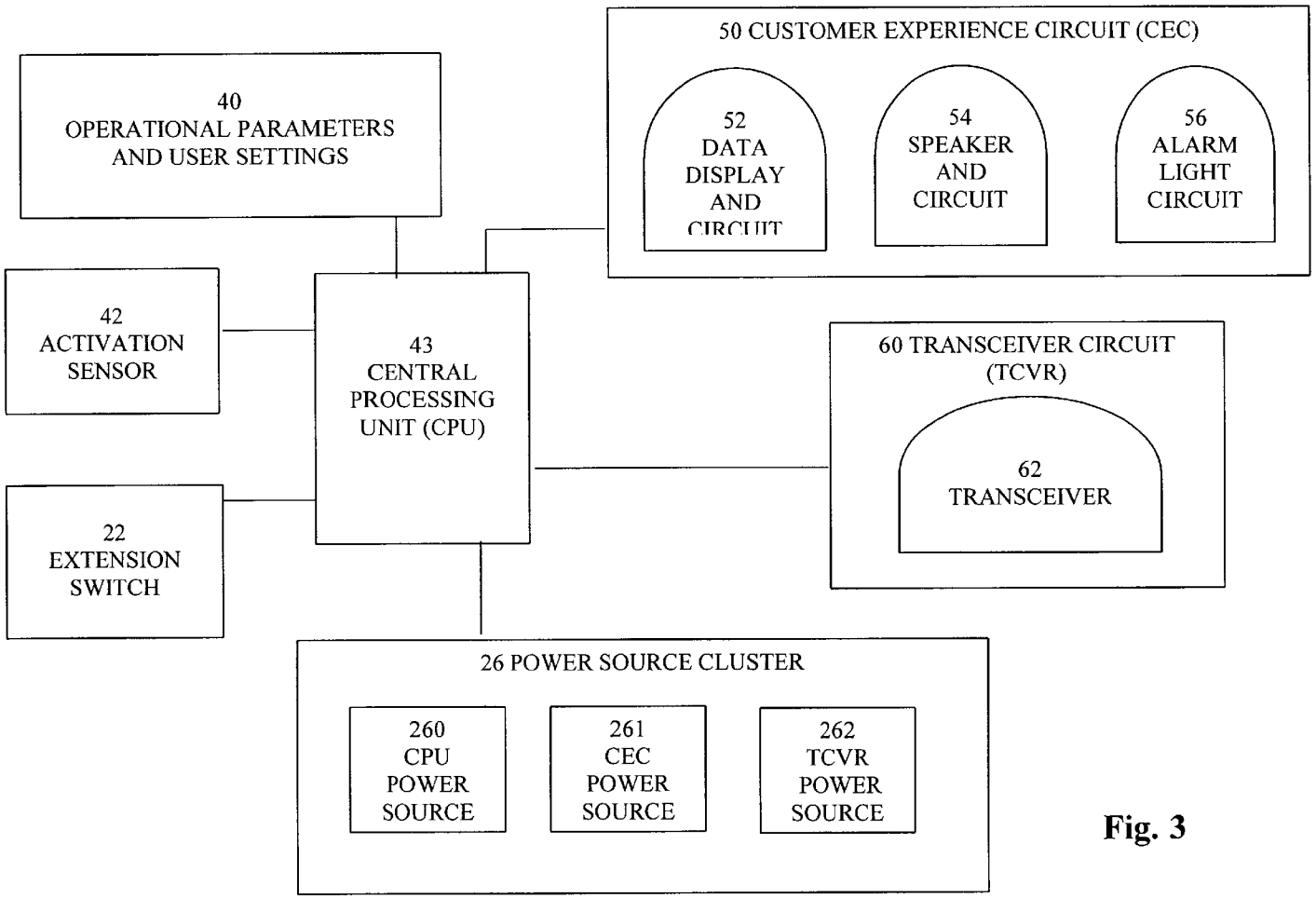
FIG. 3 is a block diagram of the pacing device of the present invention.

Referring now chiefly to FIG. 3, the system is controlled by a plurality of preset operational parameters (see listing in FIGS. 5A and 5B) and user-controlled settings stored in a data table 40 that comprises the customer experience settings. Included in these settings are the choices for which alerts will be in use, and how long the alerts will be given after activation. The user of the system also sets the duration of the pace time intervals and the alert time intervals according to how he wants to pace the play on the course on a given day. If the user desires to move play as quickly as possible, he will set the pace timing interval to the shortest preset time. If the user chooses a more leisurely pace, the pace timing interval will be set to a greater pre-programmed time period.

Power on of the device is activated either by an external means or by moving the flag stick. When the unit 10, 10' is moved through an arc of approximately 45°, an activation sensor 42 is activated. (The arc which triggers the activation sensor 42 can vary depending upon which specific sensor is used in a particular application.) The triggering of the activation sensor 42 indicates to the CPU 43 that the flag stick 12 has been returned to vertical, and that the pace interval is to be reset by means of an initialization sequence. In the preferred embodiment, at least some portion of the functional components of the CPU 43 can be located at a base station. It should be recognized that it is certainly possible to include the entire CPU 43 in the flag stick 12.

The customer experience unit (CEC) 50 controls the display and/or warning mechanisms that comprise means of contact with the golfers. The CEC 50 comprises a data display control circuit 52, a speaker and controlling circuit 54, and an alarm light circuit 56. The flag stick units are in communication with a central base unit by means of a transceiver 62 that is controlled by a transceiver circuit 60.

Figure 4A:
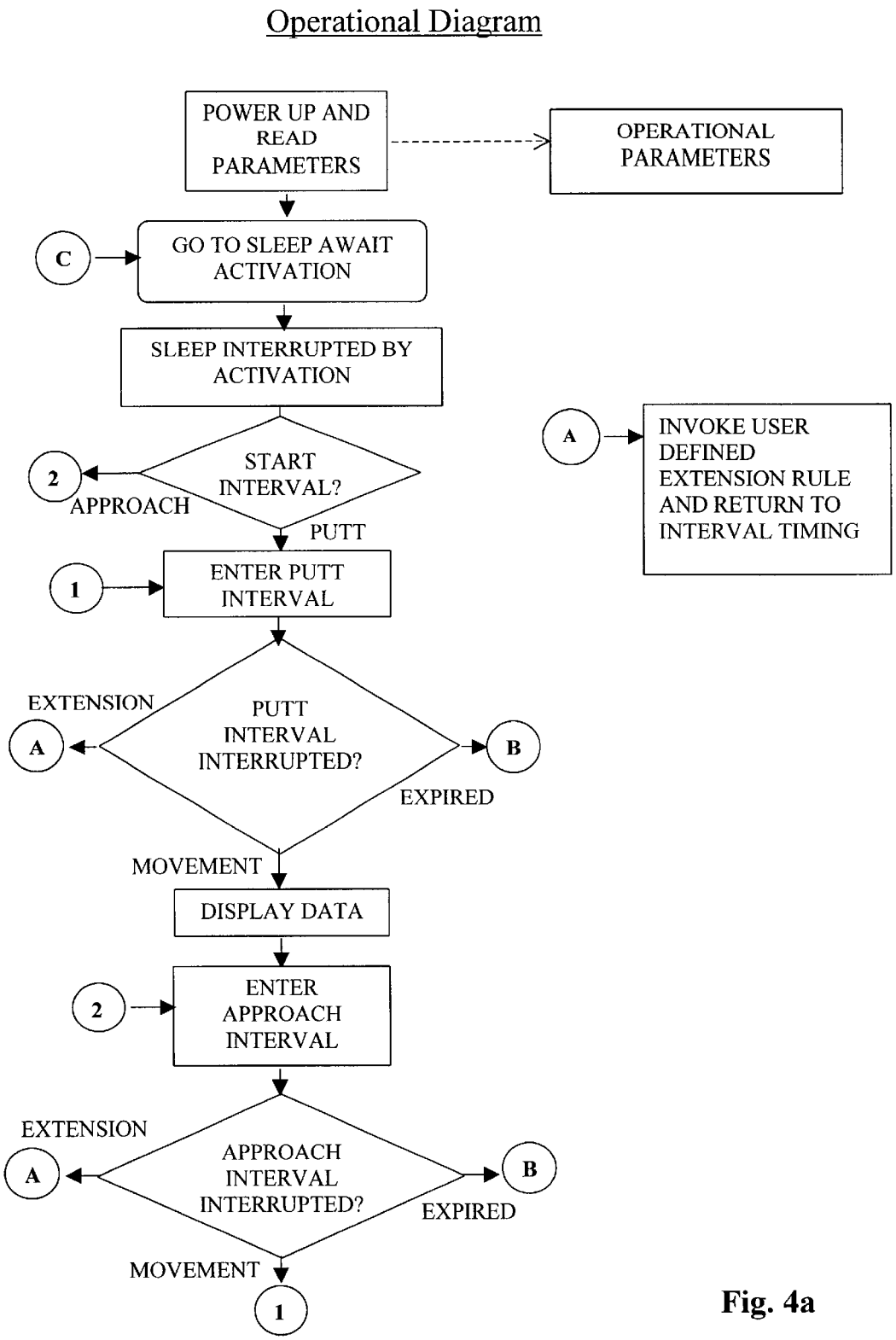
FIG. 4A is a first portion of an operational diagram of the system of the present invention.
Figure 4B:
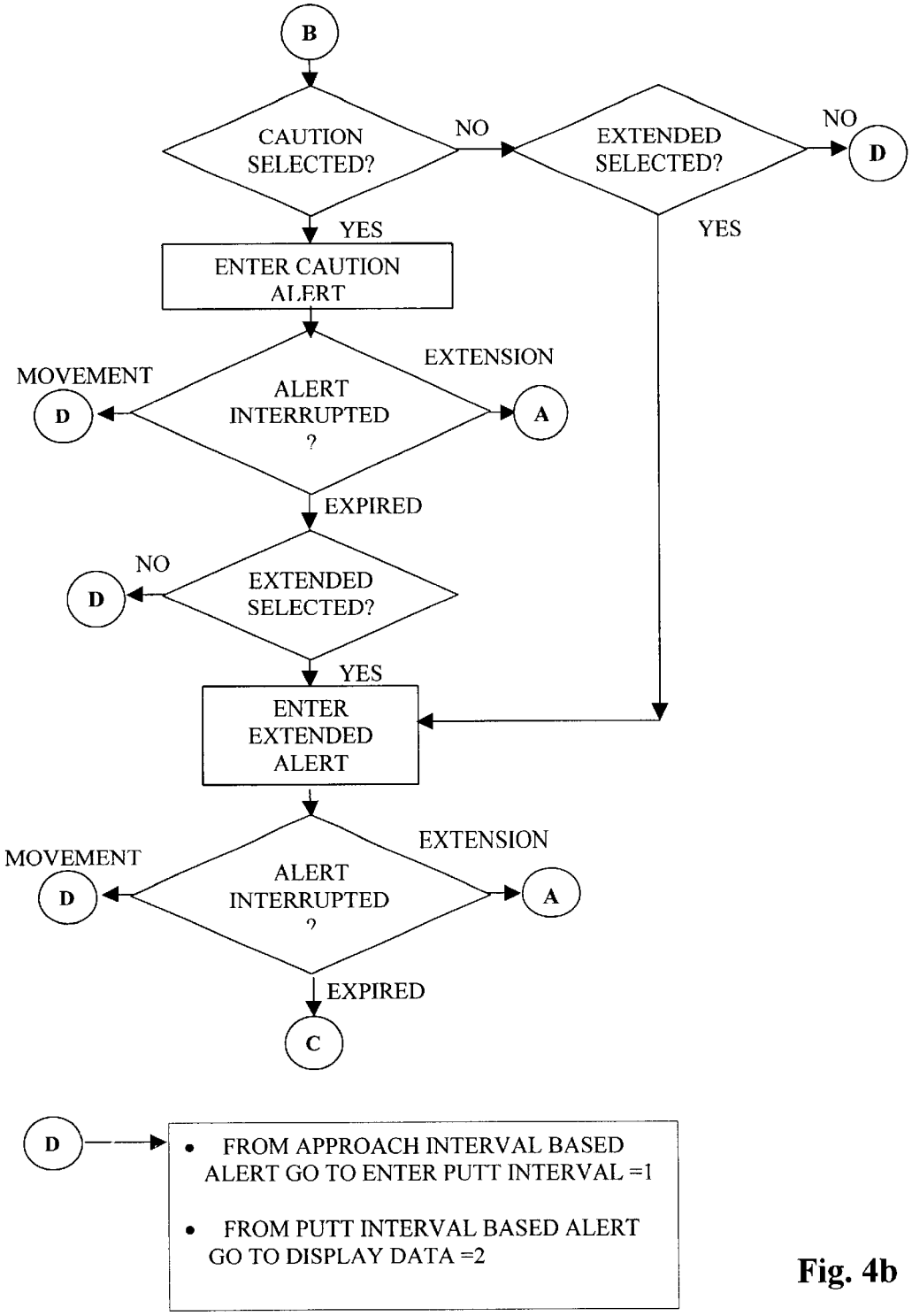
FIG. 4B is a second portion of an operational diagram of the system of the present invention.

The operation of the system using the units 10, 10' can best be understood with reference to the operational diagram shown in FIGS. 4A and 4B. The CPU program includes several sub-routines that control the function of the device.

Upon powering up the system, an initialization sequence determines the means of activation and (a) clears and resets the RAM locations, (b) reads the putting and alert timer interval settings, (c) reads the extended timer and approach interval settings, and (d) if the device is set for wireless transmission, the CPU reads the unique digital code programmed for the unit. Depending on the settings found when the putting, approach, and alert timer settings are read, lookup tables are indexed and the associated timing values are stored in the appropriate RAM locations. The system then enters a sleep state until activated by a golfer moving the flag stick to an angle sufficient to trigger the activation sensor 42.

Movement of the flag stick through a sufficient arc activates the sensor 42 and generates a signal to rest or activate timing sequences. Thus, when play is continuous, the unit 10, 10' will be operated by the golfers removing the pin from the cup so that the flagstick is tilted significantly, and then replacing the pin in a vertical position. In the preferred embodiment, the flag stick must be moved through an arc of approximately 45°, The software for the system contains provisions to eliminate the effect of slight natural movements of the pin.

Separate Play and Alert intervals are stored in the program (Total Play and Approach and Putt). These intervals designate the length of play time to be measured and the length of time for which alert alarms are activated. If the Putt Interval is enabled, the Play Interval and alert alarms are split into Approach and Putt intervals. The sequence for Play, or Approach and Putt Intervals are similar in operation. The system calls up a preset interval time and monitors the time used by the players. Once a Play interval time has been exceeded, the program enters the associated Alert Timing sequence. The system remains in an alert-on state until the alert time interval elapses or until the time-out state is activated.

Typically an initial movement through a sufficient are indicating removal from the cup will awaken the system. Upon initial activation the device does not actively measure intervals until the flag stick is replaced in the cup, causing the system to enter the Play Interval or Approach Interval timing sequence. The program remains in this Play Interval state for the chosen time interval or until the time-out state is triggered by a player moving the flag stick to again activate the sensor 42, indicating removal of the stick from the cup for putting. If the Putt Interval is enabled, upon removal of the flag stick from the cup, the system enters the Putt Timing sequence. If the Play interval is not split (i.e. the Putt Interval is not activated), the system will continue to measure elapsed play time as part of the Play Interval.

Following play, when the flag stick is returned to the cup on a given hole, the data display means 18 of the system displays the target total play interval comparison to actual play intervals. This data can, according to settings chosen by the user, be displayed as total target time compared to total elapsed time, or by approach and putt target times compared to approach and putt actual times.

If a Play Interval time expires before the time-out state is activated, two events can be triggered depending on the options selected. The alarm mechanisms can be activated, and the system put into the Alert Timing sequence. The system remains in this state for the chosen time interval or until the time out state is triggered by a player moving the flag stick to again activate the sensor 42, indicating that the pin has been replaced in the cup. If the option has been selected, the transceiver 42 emits a status signal to a base station. Management of the course is thereby able to identify the slow playing parties, and take appropriate action.

The Putting Interval sequence monitors the putting time of players in the same way as the Approach Interval sequence monitors the approach play.

By using the system of the present invention, golf course management will be able to pace the play according to conditions. An acceptable time range for the pace of each hole will be loaded into the operating parameter table 40. Within the acceptable time range will be a plurality of time alternatives, each corresponding to a setting chosen by the golfers or by course management.

Using the system of the present invention, golfers can be alerted when they have exceeded the appropriate time for a given hole. By controlling the pace of play in this manner, course management will be able to maximize the efficiency of use of the course, thereby ensuring maximum enjoyment for all users.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A golf play pacing method comprising the steps of:

a) providing a memory means to store a plurality of user defined parameters;

b) providing a processor means to perform timing functions, alerting functions, and communicating functions based on said user defined parameters;

c) providing activation means in flag sticks adapted to be used on a golf course, said activation means being in communication with said processor means;

d) triggering said activation means;

e) said activation means then causing said processor means to measure at least one target time interval defined by said user defined parameters; and f) said processor means then activating at least one of said alerting functions when, before said activation means provides a time out signal, said at least one time interval exceeds a target time interval defined by said user defined parameters.

2. The golf play pacing method of claim 1 wherein:

said activation means is triggered by moving at least one of said flag sticks.

3. The golf play pacing method of claim 1 wherein:

said activation means is triggered by a device external to said flag sticks.

4. The golf play pacing method of claim 1 wherein:

a measured playing time and said at least one target time interval are displayed to golfers on the golf course by means of display means on said flag sticks.

5. The golf play pacing method of claim 1 wherein:

said timing functions include means to define at least two timing intervals.

6. The golf play pacing method of claim 5 wherein:

said at least two timing functions include at least two play intervals.

7. The golf play pacing method of claim 5 wherein:

said at least two timing functions include at least two alarm intervals.

8. The golf play pacing method of claim 1 wherein:

said alerting functions include a visual alert means in said flag sticks and a means to trigger a base device remote from said flag sticks.

9. The golf play pacing method of claim 8 wherein:

said means to trigger a base device comprises generating an FM signal.

10. The golf play pacing method of claim 8 wherein:

said means to trigger a base device comprises generating an infrared signal.

11. The golf play pacing method of claim 8 wherein:

said means to trigger a base device comprises generating a radar signal.

12. The golf play pacing method of claim 8 wherein:

said means to trigger a base device comprises magnetic sensing means.

13. The golf play pacing method of claim 1 wherein:

a manual time extension switch is included to manually terminate said alerting functions.

14. The golf play pacing method of claim 1 wherein:

said activation means is integral to said flag sticks.

15. The golf play pacing method of claim 1 wherein:

said activation means is included in an independent element affixed to said flag sticks.

16. The golf play pacing method of claim 1 wherein:

said activation means is triggered by moving said flag sticks through an approximately 45° arc.

* * * * *